United States Patent [19]

Santucci

[11] 4,026,419

[45] May 31, 1977

[54] INDUSTRIAL TECHNIQUE

[75] Inventor: Michael Charles Santucci, Barberton, Ohio

[73] Assignee: The Babcock & Wilcox Company, New York, N.Y.

[22] Filed: Oct. 29, 1975

[21] Appl. No.: 626,960

[52] U.S. Cl. ..... 214/1 H; 214/1 QD; 294/81 R

[51] Int. Cl.[2] ..... B65G 7/00

[58] Field of Search ..... 214/1 P, 1 H, 658, 1 QD, 214/1 R, 1 Q; 29/202 R, 157.4; 294/81 R, 67 AA

[56] References Cited

UNITED STATES PATENTS

| | | | |
|---|---|---|---|
| 2,213,718 | 9/1940 | Reed et al. | 294/81 R |
| 2,703,252 | 3/1955 | Blackwell | 214/1 QD X |
| 3,253,852 | 5/1966 | Wheat | 294/81 R X |
| 3,644,976 | 2/1972 | Roberts, Jr. | 29/157.4 |
| 3,644,978 | 2/1972 | Sullivan et al. | 29/202 R |
| 3,762,756 | 10/1973 | Cole | 294/81 R |
| 3,797,877 | 3/1974 | Soehreus | 214/1 QD |

*Primary Examiner*—Frank E. Werner
*Attorney, Agent, or Firm*—Joseph M. Maguire; Robert J. Edwards

[57] ABSTRACT

An illustrative embodiment of the invention provides a cost effective reuseable erection system for use in the erection and handling of pendant superheater modules of a steam generating system. Sections of the modules are attached to and enclosed in a simple supporting and stabilizing framework which may be detachably connected to a lift beam disposed in spaced relation and aligned longitudinally above the module section in the lateral plane through the center of gravity of the module - framework structure. This disposition of the lift beam enables a single lift line, attached to the lift beam at the longitudinal plane of the center of gravity of the module-framework-lift beam structure, to lift the structure during handling and erection. Further, since the lift beam is detachable and therefore not part of the supporting framework a substantial savings in framing material and shipping and storing fees is established.

4 Claims, 4 Drawing Figures

INDUSTRIAL TECHNIQUE

BACKGROUND OF THE INVENTION

1. FIELD OF THE INVENTION

This invention relates to heat exchangers, and more particularly, to techniques for handling and erecting pendant superheaters of a steam generating system.

2. DESCRIPTION OF THE PRIOR ART

In the construction of steam generating systems, such as the commonly known power stations of the electrical utilities, the handling and erection of bulky and heavy steam generating components is both difficult and costly. One such component, the pendant superheater, is a heat exchanger suspended from supports at the upper portion of a steam generator generally consisting of a plurality of long interconnected tubular elements connected to a header. These tubular elements are commonly assembled in a plurality of spaced panel arrangements, called platens, oriented in a plane perpendicular to the longitudinal center line of the header and extending along the length of the header which may be as large as 50 feet or more. Obviously, it is extremely difficult, and excessively costly to erect one complete pendant superheater up to its above ground operating position. However, it is also desirable to fabricate as much of the superheater as is practical to erect, and thereby reduce expenses, for example, incurred in erecting rigging and performing a substantial amount of superheater welding in an above ground on location condition.

Heretofore, it has been the practice in the shipment, handling and erection of steam generator components, such as pendant superheaters, to package and support a segment or section of a superheater header and accompanying tubes in a heavy timber or metal framework. Moreover, it is essential that provision be made for lifting this segment of the superheater, including the framework, as by a crane hoist, in order to place the superheater segment on and remove it from a freight car or other transport vehcile, as well as to erect the superheater segment into its operating position. However, the cost of such framework for each superheater and the cost to return an empty frame back to the construction plant to fit another superheater segment thereto for shipment or for storage may be economically impractical. Furthermore, each such frame structure must be specially constructed to accommodate each superheater segment, and because weight is a determining factor in the size of the component to be erected, the heavy framework may reduce the size of the component or segment to be lifted.

Accordingly, there is a need to provide industry with a more economical structure which is adaptable to the handling and erection of many steam generator components, such as pendant superheaters.

SUMMARY OF THE INVENTION

These difficulties are overcome to a large extent through the practice of the invention. Illustratively, a steam generator component handling and erection structure according to this invention comprises a plurality of simple and inexpensive support means, to contain, support and stabilize the component, and a separate reuseable disconnectable lift beam to lift and orient the component during handling at the manufacturing plant, during shipping and at the erection site.

Specifically, the instant invention embodies a handling and erection structure, for a section of a pendant superheater, which includes a plurality of angle frame support means and a detachable lift beam having attachment means thereon to support the superheaterangle frame configuration suspended from the lift beam. The angle frames and lift beam form in their operative relationship an enclosing structure, in part, about the section, wherein the enclosing structure has a longitudinal span generally equal to the length of the lift beam, a width or lateral dimension, at least equal to the width of the angle frames, and a height or vertical dimension, as measured from the bottom of the support means to the top of the lift beam. Further, the lift beam includes additional attachment means on the beam disposed at the longitudinal plane through the center of gravity (c.g.) of the complete structure for connection to a lift line, such as a crane hoist, for lifting the superheater during handling and erection.

MOre specifically, as indicated above, the erection of a pendant superheater is implemented in sections with each section being handled and erected by the instant invention. Accordingly, a section of the superheater including a header portion, is arranged such that the tube platens are oriented substantially parallel to the ground plane and the header portion is disposed in a vertical orientation. For handling, that is, to contain, support and stabilize the superheater section, a plurality of angle frames, specially constructed for the section to be handled are disposed about the platens in a plane substantially perpendicular to the ground plane and substantially perpendicular to the platen's longitudinal center line. Wherein, the above mentioned angle frame is a simple supporting framework having attachment means thereon. An additional angle frame is securely attached to the header portion not only for support and stability during handling but also to support the superheater section during erection.

For lifting and erecting the superheater section, the lift beam, having attachment means thereon, is longitudinally disposed in spaced relation above the superheater section in the lateral plane through the center of gravity (c.g.) of the superheater - angle frame combination and detachably connected to the heater-frame combination by the attachment means on both the beam and the angle frames. Moreover, a single lift line connected to the lift attachment means on the beam positioned in the longitudinal plane through the c.g. of the beam - superheater - frame structure is therefore able to lift the complete structure for handling or erecting without longitudinal or lateral rotation of the structure.

During erection, the superheater - angle frame combination is disposed in a position such that the header angle frame is substantially aligned with the intended erected position of the superheater. The lift line of the lift beam exerts a vertically oriented force on the beam which raises the total structure a sufficient distance such that a second lift line attached to the header angle frame is able to rotate the structure to a vertical orientation, that is, into its erected operating position. With the header lift line supporting the structure a third line is attached to the lift beam and the angle frames about the platens are disconnected, the header frame is detached from the beam and the lift beam is removed from the suspended superheater. The superheater may then be connected to the permanent supports provided therefor on the steam generator.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENTS OF THE INVENTION

For a more complete appreciation of the invention, attention is invited to the following description of an illustrative embodiment of the invention, as shown in the attached drawings.

Figure 1:
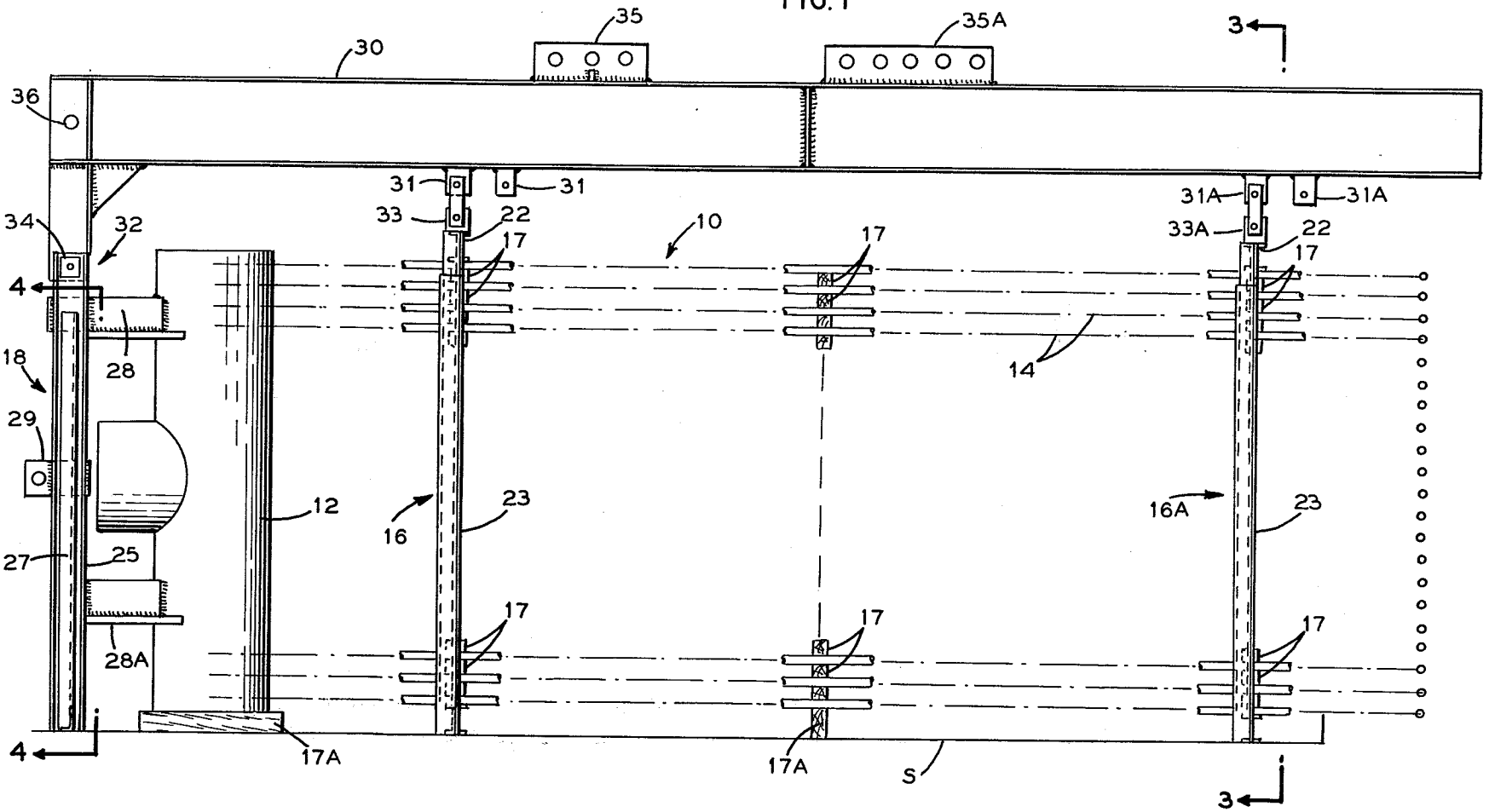
FIG. 1 is an elevation view of the handling and erection device of the present invention with a section of a pendant superheater supported thereby.

Referring now to FIG. 1, a section of a pendant superheater 10 is shown supported in accordance with this invention in a general horizontal position, resting upon spacers 17 and 17A on a surface S, a common disposition for handling and shipment. The superheater section 10 comprises a header portion 12 and a plurality of long heat exchange tubular elements 14 disposed in a plurality of spaced panel arrangements, known in the art as platens. As shown, the platens are generally oriented in a plane perpendicular to the header 12. In its operating position, the pendant superheater formed by a plurality of interconnected superheater sections 10 is suspended in the steam generator system (not shown) such that the platens are disposed in a vertical relationship.

Figure 3:
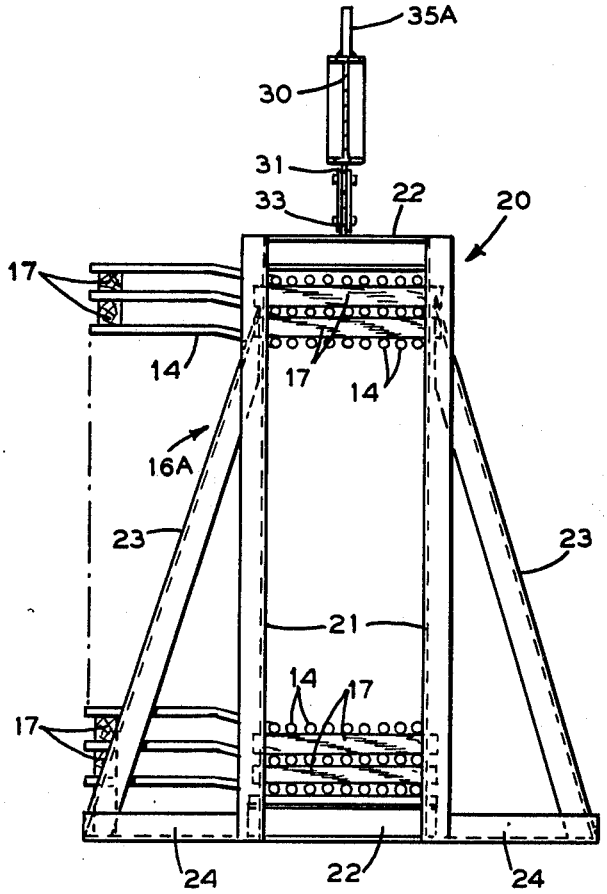
FIG. 3 is a sectional view taken along line 3—3 of FIG. 1.

To contain, support and stabilize the equipment to be handled and erected, simple frame structures, angle frames, having a two-dimensional shape, that is, height and width but generally no depth other than the thickness of the I-beam or angle iron members forming the framing structure, are provided to attach to or enclose a small portion of the equipment. In particular, angle frames 16 and 16A, FIGS. 1 and 3, in accordance with this invention enclose, in part, the platens, and angle frame 18, FIGS. 1 and 4, attaches to the header 12. In this embodiment, angle frame 16A, a duplicate of frame 16, is an enclosing rectangular structure 20 formed by a plurality of upright portions 21 overlapping the platens at both the top and bottom of the superheater section, having cross members 22 attached to the upright portions 21 at both the top and bottom of the structure to complete the enclosure. Further, in order to increase the stability of the frame, angular portions 23 extend outwardly and downwardly from the upright portions 21 and attach to horizontal portions 24 extending outwardly from the bottom cross member 22. As shown, the angle 16A or, more particularly, the enclosing structure 20 envelops the platens of the superheater section 10 to be erected, and in conjunction with a plurality of interconnected spacers 17, commonly interposed between platens to prevent excessive vibration of the tubes, supports and stabilizes the section during shipment and handling.

Figure 2:
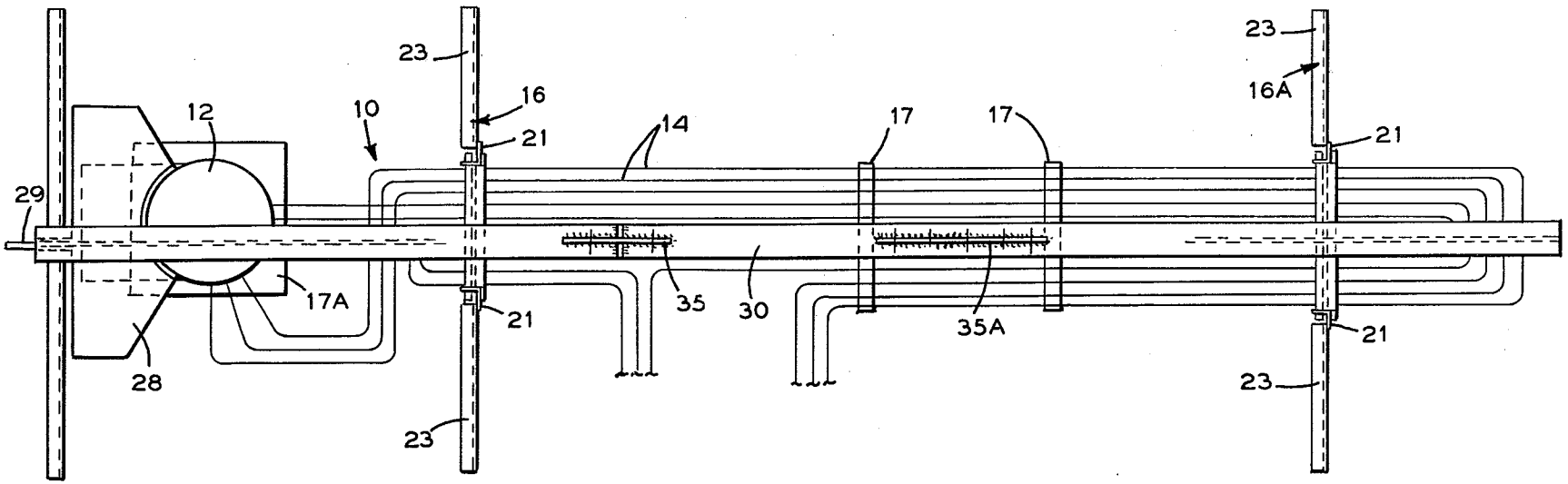
FIG. 2 is a plan view of FIG. 1.
Figure 4:
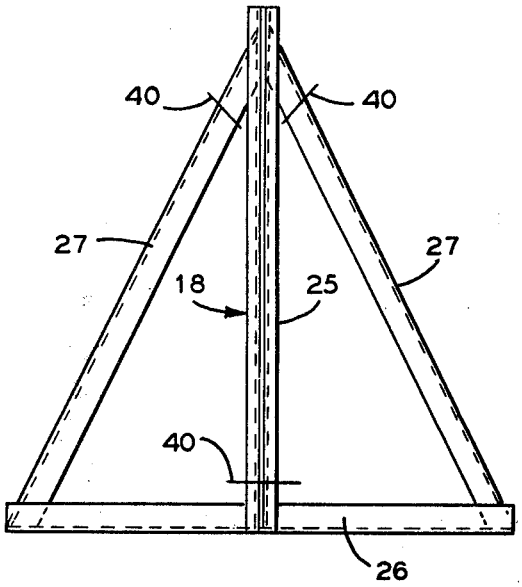
FIG. 4 is a sectional view taken along line 4—4 of FIG. 1.

The angle frame 18 or header frame shown in FIG. 4 is a variation of the angle frame 16A described in connection with the platens. The header frame 18 is generally triangular in structure, having a single upright portion 25 connected to a cross member 26 in an inverted 'T' arrangement, instead of the enclosing rectangular structure fromed by the uprights 21 and the cross members 22 of angle frame 16A. Extending upwardly and inwardly from the ends of the cross member 26 are angular portions 27, similar to the angular portions 23, of frame 16 which connect to the upright 25 at its upper end. The triangular frame so formed is attached to the superheater header 12 by structural member 28 and 28A (FIGS. 1 and 2) extending outwardly from the upright 25 in a direction substantially perpendicular to the plane formed by the angle frame 18 and in general alignment with the longitudinal disposition of the superheater tubes 14. The angle frame 18 also includes vertical attachment means 29 disposed on upright 25 in the vertical plane through the center of gravity of the superheater for use during erection thereof, as explained below.

For handling and erection of the superheater section 10, a lift beam 30 is provided having attachment means 31, 31A and 32 disposed thereon for detachable connection to attachment means 33, 33A and 34 of the angle frames 16, 16A and 18, respectively, supporting the superheater section. The lift beam 30, typically a longitudinal member such as an I-beam, further includes a longitudinal center of gravity, c.g., attachment means 35 and 35A disposed in the longitudinal plane through the center of gravity of the superheater - angle frame - lift beam combination. As shown by c.g. attachment means 35 and 35A various components having widely different longitudinal positions of center of gravity can be handled by the one lift beam 30 and its various longitudinal c.g. attachment means. In this way, a single hoist or crane lift line (not shown) detachably connected to the c.g. attachment means 35 is capable of lifting the combination, equipment, frames and beam, without having the combination rotate in the longitudinal direction. Further, by disposing the lift beam 30 in the lateral plane through the combination's e.g., rotation in the lateral direction is also precluded. Therefore, only a single lift line is required to lift the equipment, superheater section 10, during handling. Futher, by shipping a single lift beam 30 to the construction site, each of the shipped superheater sections, supported by angle frames may be unloaded, handled and erected at the site by the one lift beam. That is, the framework for containing and supporting each piece of equipment or each section of pendant superheater during shipment, handling and erection does not require or include lifting framework, or lift beam structural material built into the framework, as commonly found in the prior art frames. Accordingly, the one lift beam capable of lifting each superheater section-frame structure provides an obvious economic savings in material, that is, a cost effective frame, and a savings in shipping fees since no empty lift structure need be shipped back to the plant or included in each equipment-framework structure transported to the construction site.

The operation of this invention for erection purposes is as follows. As indicated above with respect to simply lifting the superheater, the lift beam is disposed in the lateral plane through the c.g. of the superheater, - angle frame - beam combination and is connected to the angle frames 16, 16A and 18. Prior to lifting the section 10 into its erection position, the header 12, and more particularly, the header angle frame 18 is substantially aligned with the operational erected position of the superheater section, and the header angle frame 18 is cut at the positions 40 indicated on FIG. 4 leaving only the upright 25 of frame 18 attached to the superheater 10 and the lift beam 30. A lift line attached to the longitudinal c.g. attachment means 35 or 35A, for this particular section, lifts the combination of superheater, frames and lift beam a sufficient distance above the surface S such that a second lift line, for example, the steam generator construction bome line, attached to the vertical c.g. attachment means 29, at the header end, is able to rotate the combination to a generally vertical position without having the other end contact the ground or surface S. While the surperheater is supported in this vertical orientation, a third line is attached to a beam removal attachment means 36, the beam may be detached from the angle frames or the attached frames may be cut free from the superheater and the lift beam or lift beam and angle frames are removed. The lift beam 30 is ready to be attached to another superheater - angle frame combination for erection. The vertical superheater is then maneuvered into and connected to its operating position.

In accordance with this invention, handling and erection of equipment such as a superheater section of a steam generator system is accomplished by a simple frame structure and a reuseable detachable lift beam adaptable to various combinations of frames and equipment.

What is claimed is:

1. In combination with steam generator components and apparatus for the erection thereof, said apparatus comprising means for supporting said components, lifting means disposed above the lateral center of gravity of said components, means for mounting said supporting means to said lifting means, means disposed along said lifting means for detachable connection to a lifting line for lifting said components and means disposed along one of said supporting means for positioning said components into an erected orientation.

2. In combination with boiler components and apparatus for the erection thereof, said apparatus comprising a lifting member having a longitudinal first portion fixedly connected to a second portion depending therefrom, first attachment means disposed along said longitudinal portion for detachably mounting the boiler components thereunder, second attachment means detachably mounting the boiler components to the second portion, and third attachment means disposed along the longitudinal portion for detachably connecting the device to a first lifting line for lifting the device and the boiler components mounted thereunder.

3. A device according to claim 2 further comprising a plurality of framing members for suppporting the boiler components, one of said members being detachably connected to said second attachment means and the remaining members being mounted to said first attachment means.

4. A device according to claim 3 further comprising fourth attachment means disposed along the framing member detachably connected to said second attachment means, said fourth attachment means detachably connecting the last named framing member to a second lifting line for orienting said lifted device and said boiler components into an erected position.

* * * * *

UNITED STATES PATENT AND TRADEMARK OFFICE

CERTIFICATE OF CORRECTION

PATENT NO. : 4,026,419

DATED : May 31, 1977

INVENTOR(S) : Michael Charles Santucci

It is certified that error appears in the above–identified patent and that said Letters Patent are hereby corrected as shown below:

Column 1, line 42, "vehcile" should read --vehicle--.

Column 3, line 64, after the word angle add the word --frame--.

Column 4, line 9, "fromed" should read --formed--.

Column 4, line 46, "e.g." should read --c.g.--.

Column 5, line 4, "erection" should read --erected--.

Column 5, line 15, "bome" should read --boom--.

Signed and Sealed this

*Eighteenth* Day of *December 1979*

[SEAL]

*Attest:*

SIDNEY A. DIAMOND

*Attesting Officer*

*Commissioner of Patents and Trademarks*